US006902151B1

(12) United States Patent
Nilsson

(10) Patent No.: US 6,902,151 B1
(45) Date of Patent: Jun. 7, 2005

(54) WIRE ROPE SAFETY BARRIER

(75) Inventor: Håkan Nilsson, Västra Frölunda (SE)

(73) Assignee: Blue Systems AB, Vastra Frolunda (SE)

( * ) Notice: Subject to any disclaimer, the term of this patent is extended or adjusted under 35 U.S.C. 154(b) by 0 days.

(21) Appl. No.: 10/789,690

(22) Filed: Feb. 27, 2004

(51) Int. Cl.[7] ..... E01F 15/00
(52) U.S. Cl. ..... 256/13.1
(58) Field of Search ..... 256/13.1, 1, 32, 256/33

(56) References Cited

U.S. PATENT DOCUMENTS

2003/0122115 A1 * 7/2003 Ernst et al. ..... 256/1
2003/0222254 A1 * 12/2003 Bergendahl ..... 256/13.1
2004/0041140 A1 * 3/2004 Johansson et al. ..... 256/13.1

* cited by examiner

*Primary Examiner*—John R. Cottingham
(74) *Attorney, Agent, or Firm*—Knobbe, Martens, Olson & Bear, LLP

(57) ABSTRACT

A wire rope saftey barrier for positioning along roads and/or between carriage ways for traffic in opposite direction. The barrier includes a plurality of spaced apart posts that are substantially vertically anchored in the road side. The posts include slots that receives wire ropes which can be vertically spaced within the slots. A cover is positioned over the top of the posts and the cover is secured to the post to prevent the cover from being thrown off the post following impact by a vehicle.

5 Claims, 2 Drawing Sheets

WIRE ROPE SAFETY BARRIER

BACKGROUND OF THE INVENTION

Field of the Invention

The present invention relates to a wire rope safety barrier.

SUMMARY OF THE INVENTION

The present invention refers to a wire rope safety barrier of the type used for fencing off the carriage ways running in opposite direction on roads, and also as side fences between a road and the area directly adjacent the road, and consisting of a plurality of posts, which are spaced apart along the extension of carriage way/the road and together support at least two substantially horizontal fence ropes, preferably consisting of steel ropes or wires. Those fences are provided for preventing vehicles from traveling off the carriage way sideways, and particularly for crossing over into the opposed carriage way at accidents with cars caused by car breakdowns, collisions or the like.

The purpose of the invention is to offer such a wire rope safety barrier, which in a secure manner will catch a vehicle which is hitting the wire rope safety fence, and thereby absorb at least a major part of the weight and kinematic force from the vehicle, thus that the vehicle will be retained in its own carriage way and not cross over to the carriage way of the oncoming vehicles, or driving off the road.

It is furthermore essential that it is prevented as far as possible, that components of such a safety barrier which will come loose at a collision is not thrown over in the carriage way of the oncoming traffic.

Another purpose of the invention is to secure as far as possible that as few components as possible are thrown off the safety barrier at such a collision.

For achieving this it is suggested that a wire rope safety barrier for positioning along roads and/or between carriage ways for traffic in opposite directions, incorporates a plurality of spaced apart posts, which are substantially vertically anchored in the road side and/or in a strip positioned between the carriage ways for traffic in opposite directions, which posts in a sliding manner supports a number of wire ropes, which wire ropes are spaced apart in vertical direction and are firmly anchored under pretension in end anchors fixedly positioned at opposite ends of the wire ropes outside the positions for the posts, the wire ropes being positioned in receiving means arranged in the posts, detachable cover means being positioned on top of said receiving means, the said posts and the said cover means having cooperating hooking means, preventing the cover means from being thrown off the posts following the impact, when a vehicle hits the wire rope safety barrier.

Hereinafter the invention will be further described with reference to a non-limiting embodiment illustrated in the accompanying drawings.

DETAILED DESCRIPTION OF THE PREFERRED EMBODIMENT

Figure 1:
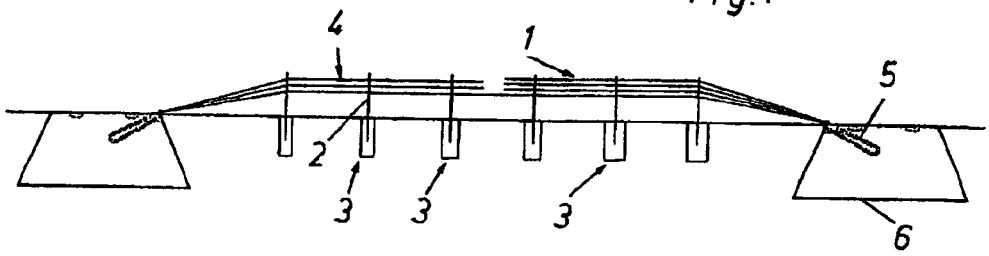
FIG. 1 illustrates schematically a section of a wire rope safety barrier according to the invention.

FIG. 1 illustrates schematically a section of a wire rope safety barrier 1 according to the invention. This barrier 1 incorporates a plurality of posts 2, which are mounted substantially vertically in footings 3, and with a mutual spacing in the longitudinal direction of the barrier 1. The posts 2 support a number of wire ropes 4, which extend substantially horizontally between the posts 2. In the embodiment shown there are four wire ropes 4 at the right hand side of the barrier and three wire ropes 4 in another embodiment shown at the left hand side, but this number can differ in view of the requirements, depending on type of road traffic, expected speeds etcetera. At the ends of the wire ropes 4, they are anchored, at both sides of the row of posts 4, in end anchors 5 embedded in anchor blocks 6. The wire ropes 4 are tensioned by means of the end anchors in a manner which will be further explained in connection to FIG. 5, thus that they can withstand smaller collision forces.

Figure 2A:
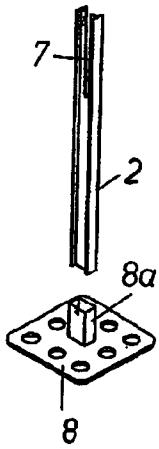
FIGS. 2*a* and 2*b* illustrate a first embodiment of a post forming part of a wire rope safety barrier and how its foot portion is anchored by being embedded in concrete.
Figure 2B:
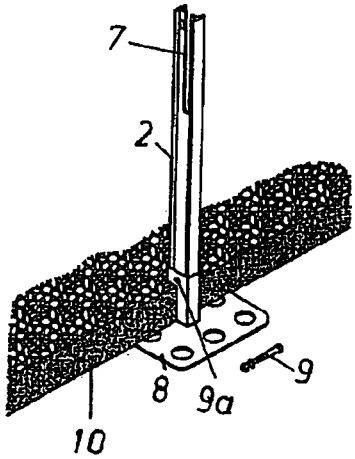

In FIG. 2*a* is shown a first embodiment of a post 2, mainly having an I-profile and having in the intermediate beam of the I-profile a slot 7 opening in the top side of the post and extending downwards a distance somewhat exceeding the distance between the upper and the lower wire rope 4 to be fitted to the posts. In this embodiment the post 2 has a separate footing 8 in form of a plate with an upright socket 8*a*. As shown in FIG. 2*b*, the footing 8 is embedded in a concrete layer 10, with the socket projecting up from the upper surface of the concrete layer. The post 2 is anchored by being inserted from above in the socket 8*a*, and then being secured by means of a bolt joint 9 extending through a bore 9*a* in socket and post.

Figure 3A:
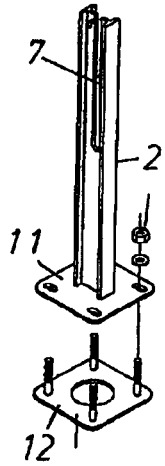
FIGS. 3*a* and 3*b* illustrate a slightly different post and how its foot is anchored by bolts to an embedded foundation plate.
Figure 3B:
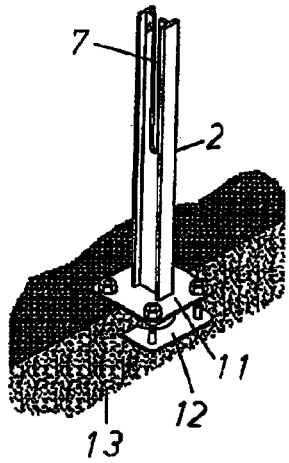

In FIG. 3*a* is shown a post 2 with a slot 7 having a base plate 11 fixedly attached thereto and in turn attached via bolts with a foundation plate 12, which, as can be seen in FIG. 3*b*, is embedded in a concrete layer 13.

Figure 4:
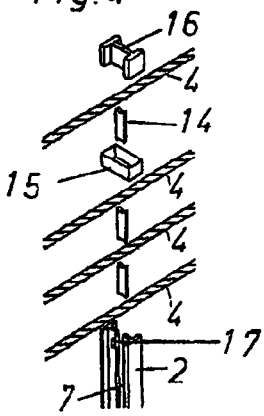
FIG. 4 is an exploded view of the top part of a post and the components with which it cooperates.

FIG. 4 shows in an exploded perspective view an upper part of a post 2, with the slot 7. Here it is seen how the different wire ropes 4 will be positioned in the slot 7, with spacing members 14 or distance spreaders positioned between two adjacent wire ropes 4. There might also be arranged stiffening frames 15 around the spacing members 14. At the top of the post 2, above the stack of wire ropes 4, spacing members 14 and stiffening frames 15 is attachable a top cover 16, arranged to form a protection of the components situated in the slot 7 in the post and also for giving a protection against damages caused when the post top end hits a vehicle. The spacing members 14 are preferably made from plastic material, whereas the stiffening frames preferably are stainless steel frames. At least one opening 17 is provided in a flange in the post 2 adjacent its upper end. The function of this opening 17 will be further described hereinafter.

Figure 5:
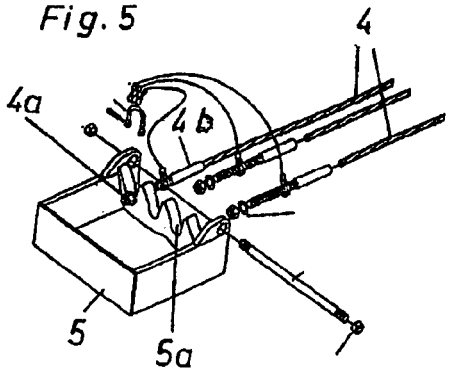
FIG. 5 illustrates an end anchor to which the ends of the wire ropes are attached and tensioned.

In FIG. 5 is showed in an exploded perspective view the end anchor 5 and its associated components. In the embodiment illustrated the main body of the end anchor is a substantially rectangular sleeve, having substantially V-shaped recesses 5*a* adapted to hold end fittings 4*a* for the wire ropes 4, and being equipped with rigging screws 4*b* for giving the wire ropes a desired preload and tension.

Figure 6:
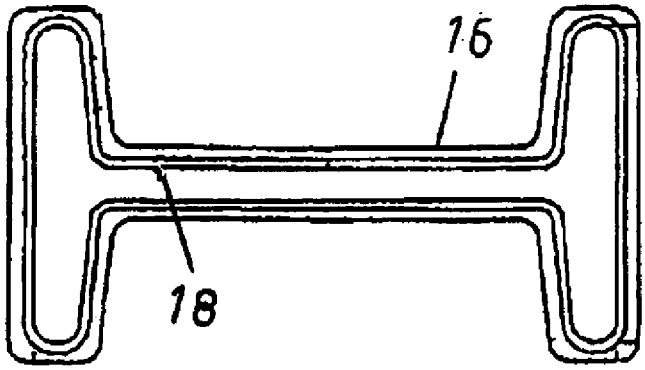
FIGS. 6–8 are views from different directions showing a cover means forming part of the wire rope safety barrier according to the invention.
Figure 7:
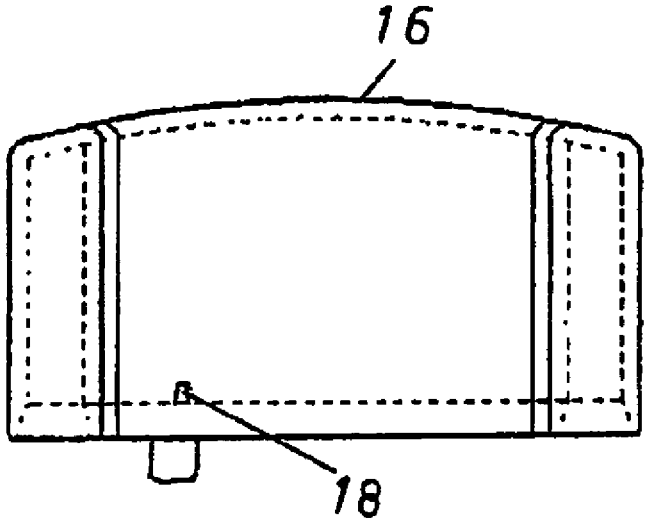
Figure 8:
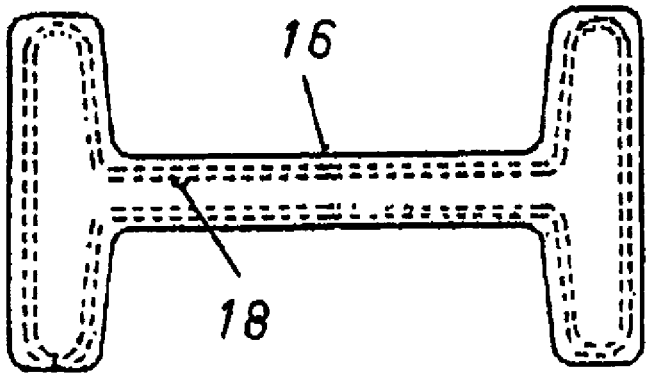

FIGS. 6–8 show in different angles a top cover 16, as can also be seen in FIG. 4. FIG. 6 shows the top cover 16 from below, FIG. 7 shows it from the longer side and FIG. 8 shows it from above. For elucidating the structure thereof FIGS. 7 and 8 is shown with hidden contours shown in dash lines, and it can here be seen that the top cover 16 is a shell-like member having a substantially I-shaped cross-section, and an inner size and shape corresponding to the outer shape and size of the cross-section of the post 2 (see FIG. 4). On the inner wall of the shell-like member 16 there is provided an inwardly directed projection 18. This projection cooperates with the opening 17 at the upper end of the post in such a manner that it penetrates into the opening and thereby provides a locking effect between the top cover and the post, when mounted thereon. Due to the inherent flexibility of the plastic top cover, the wall thereof can flex sufficiently when the top cover is fitted to the post for allowing its projection 18 to snap into the opening 17 in the post 2. It is thereby secured, that the top cover will not easily be thrown off the post at a sudden impact caused by a vehicle hitting the wire ropes 4 and/or a post 2. Thereby it is in most cases prevented that the plastic top cover, and other components attached to the safety barrier will be thrown over in the lane of the oncoming traffic.

The invention is not limited to the embodiment illustrated in the drawings and described in connection thereto, but modifications and variants are possible within the scope of the accompanying claims.

What is claimed is:

1. A wire rope safety barrier for positioning along roads or between carriage ways for traffic in opposite directions, and incorporating a plurality of spaced apart posts, which are substantially vertically anchored in the road side or in a strip positioned between the carriage ways for traffic in opposite direction, which posts in a sliding manner support a number of wire ropes, which wire ropes are spaced apart in vertical direction and are firmly anchored under pretension in end anchors fixedly positioned at opposite ends of the wire ropes outside the positions for the posts, the wire ropes being positioned in receiving means arranged in the posts, detachable cover means being positioned on top of said receiving means, the said posts and the said cover means having cooperating hooking means, preventing the cover means from being thrown off the posts following the impact, when a vehicle hits the wire rope safety barrier and wherein each post has a top end and is provided with a substantially vertical slot opening at the top end, said slots forming the receiving means for the wire rope and wherein the cover means comprises a top cap positioned on top of the post in a position closing off the upper opening of the slot wherein each of the post, close to its top, has an opening and wherein the top cap has an inward projection adapted to enter in the opening at the top of the post, the opening and the post together forming the cooperative hooking means which inhibits components of the safety barrier coming loose and being thrown away from the post in a collision.

2. A wire rope safety barrier as claimed in claim 1, wherein the projections are resilient.

3. A wire rope safety barrier as claimed in claim 1, wherein the cover means comprises a lid of plastic material having at least one resilient inward projection.

4. A wire rope safety barrier for positioning along roads or between carriage ways for traffic in opposite directions, the barrier comprising:

a plurality of posts spaced apart along the road way wherein the plurality of posts are vertically anchored in the road side wherein the plurality of posts have an I-shaped cross section with an intermediate beam and wherein the plurality of posts define a slot in the intermediate beam, the slot having an opening at the top of the post and wherein the plurality of posts further define an opening on the intermediate beam adjacent the upper end of the plurality of posts;

a plurality of wires positioned within the slots on the plurality of posts so as to extend from post to post along the roadway to thereby define a barrier;

a plurality of covers positioned on the upper end of the plurality of posts adjacent the opening for the slots, wherein the plurality of covers are deformable and include an inward projection that extends into the opening in the plurality of posts to thereby retain the covers on the post.

5. The barrier of claim 4, wherein the plurality of covers also define an I shaped cross section having a hollow interior section so as to fit over the top of the plurality of posts and wherein the projection is formed on the hollow interior section so as to be positionable into the opening formed in the intermediate section of the plurality of posts.

* * * * *